United States Patent [19]

Kobayashi et al.

[11] Patent Number: 4,607,603

[45] Date of Patent: Aug. 26, 1986

[54] FUEL INJECTION SYSTEM EMPLOYING THE SECOND TIME DIFFERENTIAL OF PRESSURE OR AIR FLOW RATE

[75] Inventors: Nobuyuki Kobayashi; Toshimitsu Ito; Kazuhiko Norota, all of Toyota, Japan

[73] Assignee: Toyota Jidosha Kabushiki Kaisha, Toyota, Japan

[21] Appl. No.: 669,723

[22] Filed: Nov. 8, 1984

Related U.S. Application Data

[63] Continuation of Ser. No. 464,111, Feb. 4, 1983, abandoned.

[30] Foreign Application Priority Data

Mar. 31, 1982 [JP] Japan ..... 57-149937

[51] Int. Cl.[4] ..... F02B 3/00

[52] U.S. Cl. ..... 123/492; 123/493

[58] Field of Search ..... 123/478, 493, 492, 425, 123/435

[56] References Cited

U.S. PATENT DOCUMENTS

| | | | |
|---|---|---|---|
| 3,673,989 | 7/1972 | Aono et al. | 123/492 |
| 4,010,717 | 3/1977 | Taplin | 123/492 |
| 4,112,879 | 9/1978 | Assenheimer et al. | 123/493 |
| 4,184,458 | 1/1980 | Aoki et al. | 123/492 |
| 4,417,556 | 11/1983 | Latsch | 123/425 |
| 4,457,283 | 7/1984 | Kobayashi et al. | 123/492 |

FOREIGN PATENT DOCUMENTS

| | | | |
|---|---|---|---|
| 0137630 | 8/1982 | Japan | 123/493 |

*Primary Examiner*—Parshotam S. Lall

*Attorney, Agent, or Firm*—Finnegan, Henderson, Farabow, Garrett & Dunner

[57] ABSTRACT

Synchronous fuel injection amount of injected from a fuel injector in synchronization with rotation of an engine is controlled in relation to the second time differential of either the intake pipe pressure or intake flow rate.

6 Claims, 7 Drawing Figures

FUEL INJECTION SYSTEM EMPLOYING THE SECOND TIME DIFFERENTIAL OF PRESSURE OR AIR FLOW RATE

This application is a continuation of application Ser. No. 464,111, filed Feb. 4, 1983, now abandoned.

BACKGROUND OF THE INVENTION

1. Field of the Invention

This invention relates to an electronically controlled fuel injection system for improving response to acceleration time of an engine.

2. Description of the Prior Art

In prior electronically controlled fuel injection systems which compute the amount of fuel injected in relation to intake pipe pressure P or intake air flow rate Q of an engine, a linear type throttle sensor is provided to generate the output voltage which is a linear function of the opening $\theta$th of the throttle so that air-fuel ratio during acceleration period is corrected in relation to the output of the throttle sensor and intake pipe pressure P or intake air flow rate Q. However, in the acceleration from light load zone, the intake pipe pressure P or intake air flow rate Q increases greatly as the opening $\theta$th of throttle increases slightly, so that the air-fuel ratio during the acceleration period is difficult to control properly in response to the condition of acceleration, and the construction of the linear type throttle sensor becomes more complicated than that of contact-type throttle sensor, leading to an increased cost for the linear type throttle sensor.

SUMMARY OF THE INVENTION

An object of the present invention is to provide an electronically controlled fuel injection system which can properly control air-fuel ratio during acceleration without using a linear type throttle sensor.

According to the present invention, to achieve this object, an electronically controlled fuel injection system for operating a fuel injector according to electric signals to inject fuel from the fuel injector to an intake system detects the second differential of the intake pipe pressure or intake air flow rate X representing whichever variable is closer with respect to time t, i.e. $d^2X/dt^2$, to increase the synchronous fuel injection amount in relation to $d^2X/dt^2$. Since the synchronous fuel injection amount is increased on the basis of the second differential of X(=intake pipe pressure P or intake air flow rate Q) with respect to time, i.e. $d^2X/dt^2$, the fuel injection amount is to be increased promptly after the start of acceleration while fuel injection of an amount related to the condition of acceleration is to be accurately carried out.

Since the synchronous fuel injection amount is increased in relation to $d^2X/dt^2$, the longer the period of $d^2X/dt^2>B$ continues, the more the increment of the synchronous fuel injection amount increases, and the increase of the synchronous fuel injection amount is maintained even after $d^2X/dt^2 \leqq B$ is provided.

Preferably, a correction factor for the synchronous fuel injection amount is defined as 1+FTC and $d^2X/dt^2$ is detected in a predetermined cycle to increase FTC by a value related to $d^2X/dt^2$ if $d^2X/dt^2>$predetermined value A, to carry out the first acceleration fuel increase of the synchronous fuel injection amount and to increase FTC by a value related to $d^2X/dt^2$ if $d^2X/dt^2>$predetermined value B, and to carry out the second and succeeding acceleration fuel increases of the synchronous fuel injection amount. FTC is decreased by a predetermined amount in a predetermined cycle, and $A<B$. By setting $A<B$, the increase of acceleration fuel of the synchronous fuel injection amount can be advanced.

An amount of change in X during predetermined time tc is defined as $\Delta X$, an amount of change in $\Delta X$ during predetermined time ta defined as $\Delta\Delta Xa$ and an amount of change in $\Delta X$ during predetermined time shorter than ta defined as $\Delta\Delta Xb$. The first acceleration fuel increase of the synchronous fuel injection amount is carried out when $\Delta\Delta Xa>A$ and the second and succeeding acceleration fuel increases of the synchronous injection amount are carried out when $\Delta\Delta Xb>B$. Also correction factor for the synchronous fuel injection amount is defined as 1+FTC and FTC is corrected in relation to $\Delta\Delta Xa$ or $\Delta\Delta Xb$. By setting $\Delta\Delta Xa$ equal to an amount of change in $\Delta X$ during a sufficiently long time ta, the first acceleration fuel increase of the synchronous fuel injection is advanced.

DETAILED DESCRIPTION OF PREFERRED EMBODIMENTS

Figure 1:
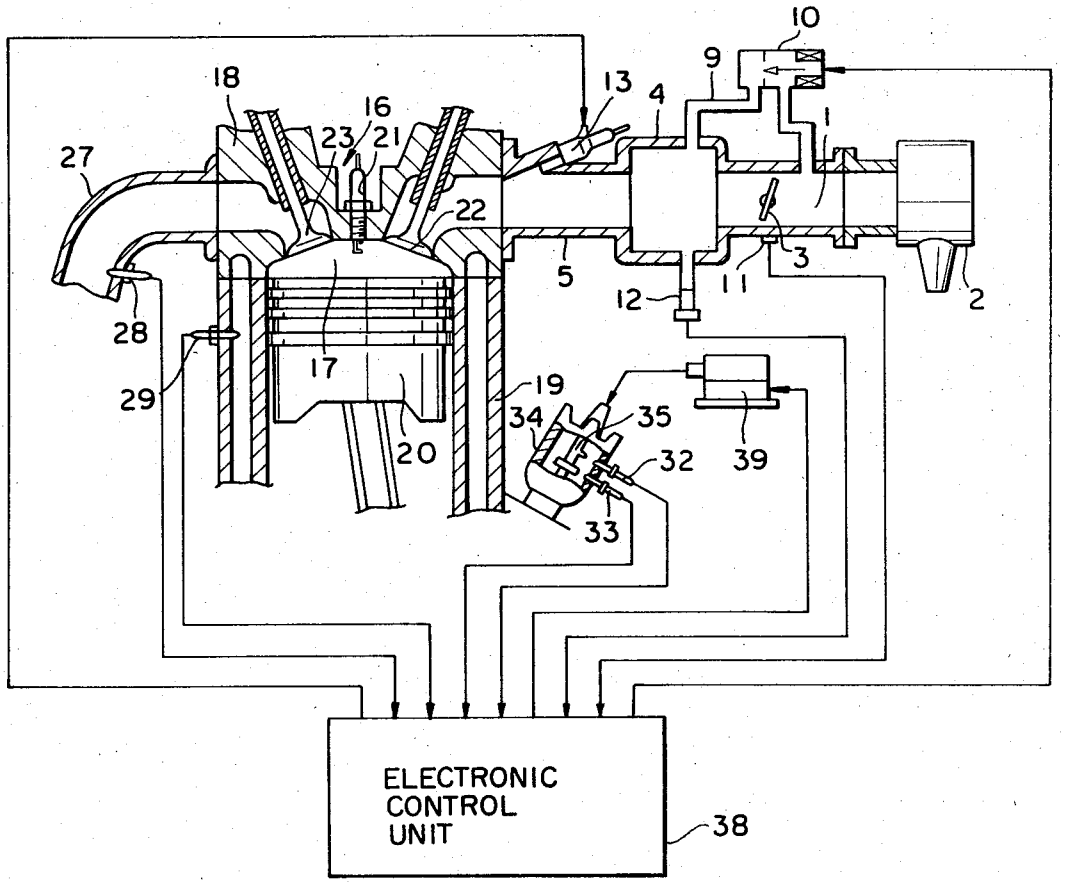
FIG. 1 is a schematic illustration of the whole electronically controlled engine according to the present invention.

As shown in FIG. 1, in an intake path 1, there are provided sequentially from the upstream thereof an air cleaner 2, throttle valve 3, surge tank 4 and intake pipe 5. A bypass path 9 interconnects the upstream portion of the throttle valve 3 and the surge tank 4 and has the sectional area of flow controlled by a controlling valve 10 for controlling a pulse motor. An idle switch 11 is turned on when the throttle valve 3 has the opening for idling and turned off when the throttle valve 3 is opened wider thanthe opening for idling.

A pressure sensor 12 detects intake pipe pressure P introduced from the surge tank 4. A fuel injector 13 provided near an intake port injects fuel into an intake system in relation to fuel injection pulse signals. A combustion chamber 17 in an engine 16 is defined by a cylinder head 18, cylinder block 19 and piston 20 and provided with an ignition plug 21. Mixture is introduced through an intake valve 22 into the combustion chamber 17 and exhaust gas is discharged from the combustion chamber 17 through an exhaust valve 23 to an exhaust pipe 27.

An oxygen sensor 28, operating as an air-fuel ratio sensor, is mounted on the exhaust pipe 27 to detect the concentration of oxygen in the exhaust pipe. A water temperature sensor 29 is mounted on the cylinder block 19 to detect temperature of cooling water. A cylinder distinguishing sensor 32 and rotation angle sensor 33 detect crank angle from rotation of a rotary shaft 35 of a distributor 34 to generate one pulse every time the crank angle changes by 720° and 30°. An electronic control unit 38 receives input signals from the respective sensors to send the output signals to an electromagnetic valve 10, the fuel injector 13 and an ignition system 39. The secondary ignition current of the ignition system 39 is sent through the distributor 34 to the ignition plug 21 in each combustion chamber 17.

Figure 2:
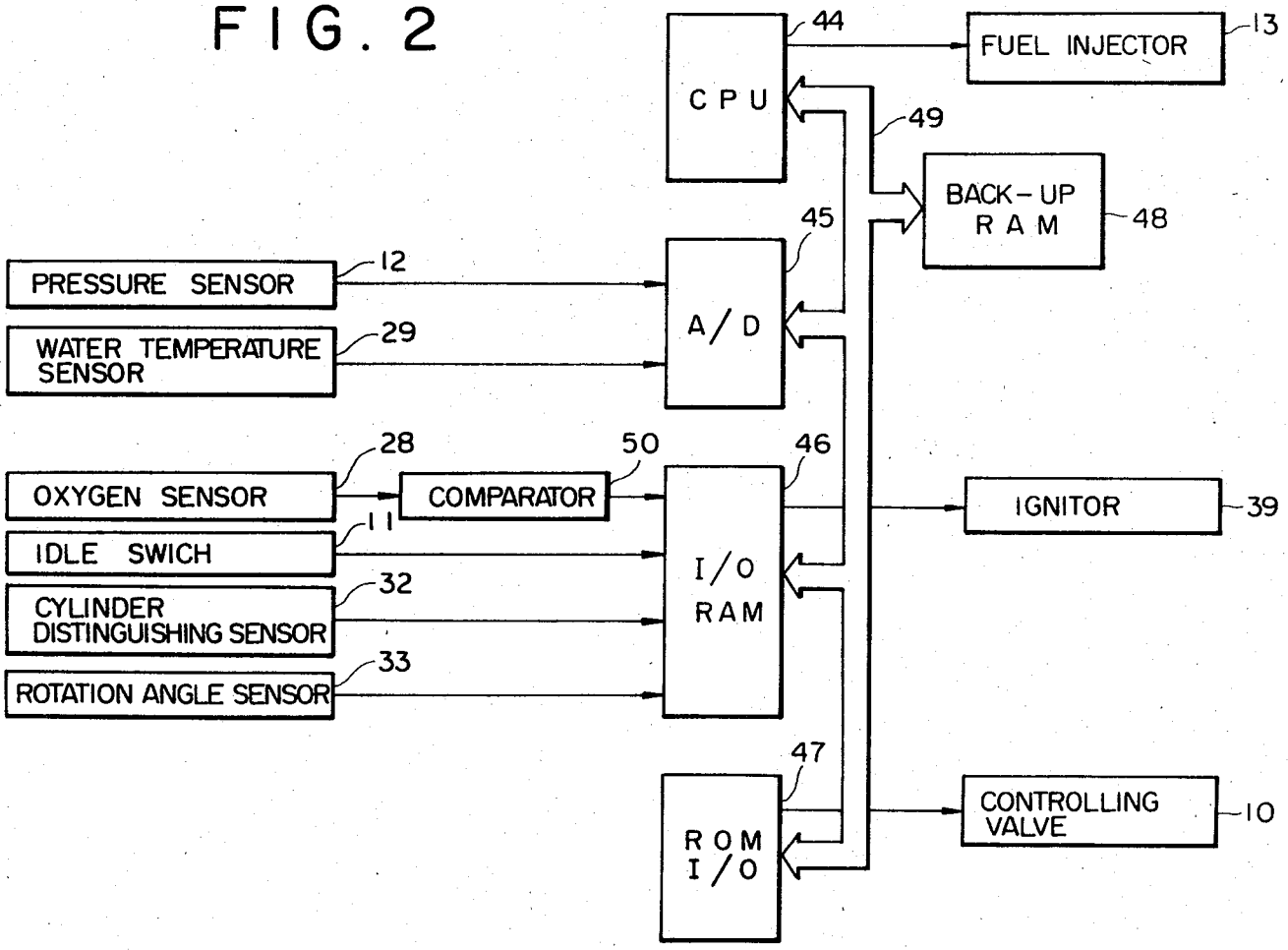
FIG. 2 is a block diagram of an electronic control unit.

FIG. 2 is a block diagram of the interior of the electronic control unit 38. CPU 44, A/D (analog/digital converter) 45, I/O (input-output interface), RAM 46, ROM.I/O 47 and back-up RAM 48 are connected to each other by a bus 49. The back-up RAM 48 is connected to a power source to hold memory even when an engine switch is turned off. Analog signals of the pressure sensor 12 and water temperature sensor 29 are sent to the A/D 45. The outputs of the idle switch 11, cylinder distinguishing sensor 32 and rotation angle sensor 33 are sent to the I/O section of the I/O·RAM 46. The output of the oxygen sensor 28 is sent to the I/O section of the I/O·RAM 46 through a comparator 50. The fuel injector 13 receives fuel injection pulses from CPU 44. The ignition system 32 receives control signals from the I/O section of I/O·RAM 46. The controlling valve 10 for controlling a step motor receives control signals from the I/O section of ROM·I/O 47.

Figure 3:
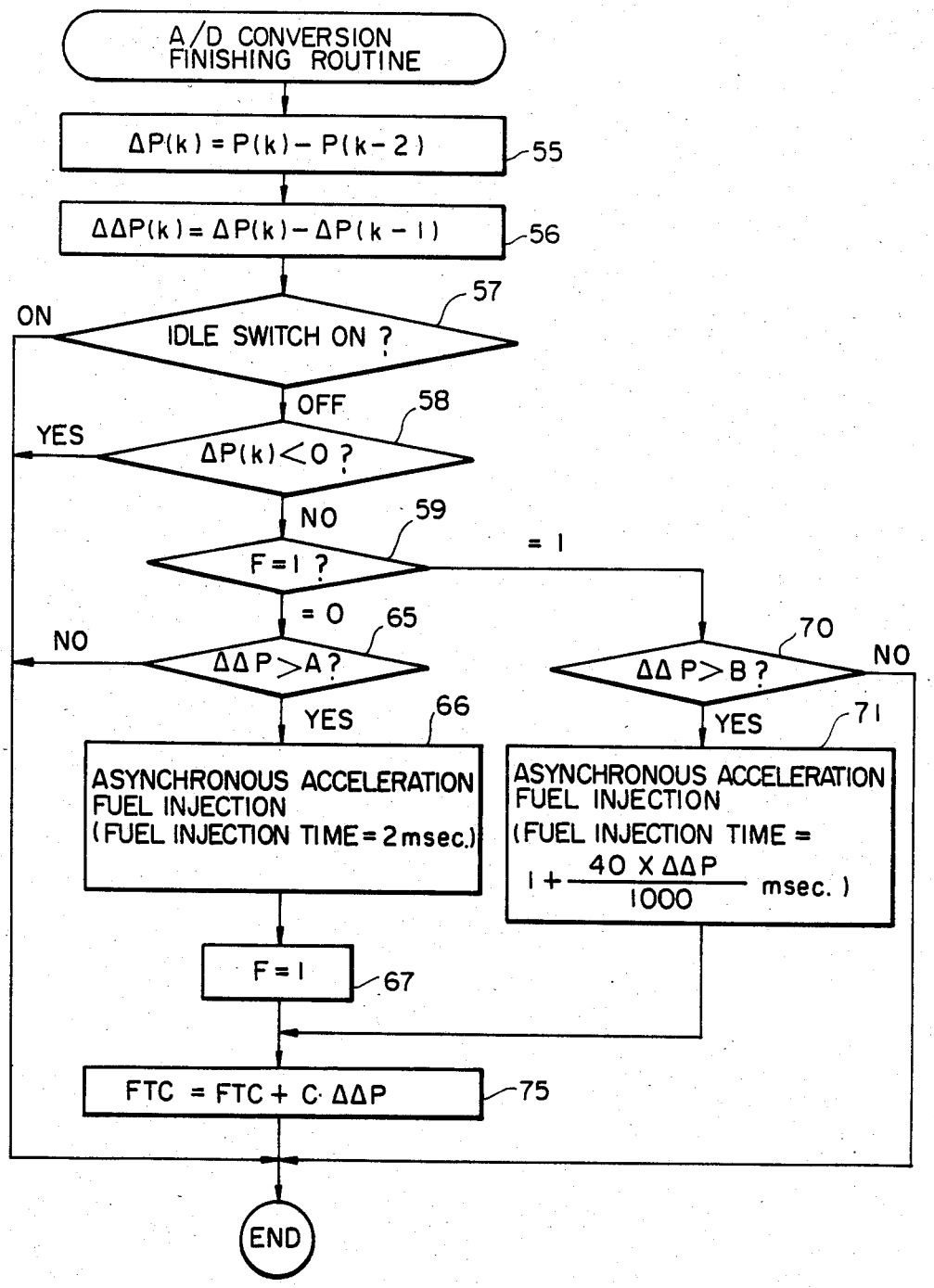
FIG. 3 is a flow chart of a program according to the present invention.

FIG. 3 is a flow chart of a program according to the present invention. Intake pipe pressure P, as represented by the value detected by the pressure sensor 12, is A/D converted every 10 msec. and this program is executed as an interrupting routine accompanying the completion of the A/D conversion. In step 55, the difference $P(k)-P(k-2)$ between intake pipe presure $P(k)$ in this time and intake pipe pressure $P(k-2)$ has been computed two times before this time, i.e. before 20 msec., to be substituted in $\Delta P(k)$. $\Delta P$ is an amount of change in P per 20 msec. and for these purposes is considered to be the equivalent to the differential of P with respect to time t, i.e., dP/dt.

In step 56, the difference $\Delta P(k)-\Delta P(k-1)$ between $\Delta P(k)$ in this time is computed, and $\Delta P(k-1)$ in the previous time, i.e. before 10 msec., is substituted into $\Delta\Delta P(k)$. $\Delta\Delta P$ as an amount of change in $\Delta P$ per 10 msec., and for these purposes is equivalent to the secondary differential of P with respect to time t, i.e., $d^2P/dt^2$. $\Delta\Delta P$ is the change in $\Delta P$ per 10 msec., not 20 msec., because acceleration must be promptly detected to execute step 66 which will be later described.

In step 57, it is judged whether the idle switch is turned on or off, and the succeeding steps are executed only when said switch is turned off. Thus, in deceleration, the asynchronous acceleration fuel injection and the increase of acceleration fuel can not be carried out.

In step 58, it is judged whether $\Delta P(k)<0$ or $>0$, and the succeeding steps are executed only when $\Delta P(k)\geqq 0$. Thus, when the opening of the throttle is reduced to lower the intake pipe pressure, the acceleration fuel injection is not executed.

In step 59, it is judged whether flag F=1 or 0 and the program proceeds to step 65 when F=0 and to step 70 when F=1. Flag F is reset to 0 when the idle switch 11 is changed over from the turned-on to turned-off condition, i.e. the throttle valve 3 is opened from the opening of idling. Thus, F=0 in the first execution of program after the start of acceleration, and the program proceeds to step 65. In step 65, it is judged whether or not $\Delta\Delta P(k>$ predetermined value A and the program proceeds to the next step 66 only when $\Delta\Delta P(k)>A$. In step 66, the asynchronous acceleration fuel injection not in synchronization with the crank angle is carried out once. By this asynchronous acceleration fuel injection, the fuel injector 13 injects fuel into the intake system only for 2 msec. for example. Since A in step 65 is set to a value smaller than predetermined value B in step 70 which will be described later, the first asynchronous acceleration fuel injection after the start of acceleration can be carried out promptly.

In step 67, flag F is set to 1. Thus, after the asynchronous acceleration fuel injection is carried out once, F=1 is judged in step 60 and the program proceeds to step 70. In step 70, it is judged whether or not $\Delta\Delta P(k)>$ predetermined value B and the program proceeds to step 71 only when $\Delta\Delta P(k)>B$. If so, step 71 is carried out and the fuel injection time $\tau au$ is set $=1+(40\times\Delta\Delta P)/1000$ msec., where $\Delta\Delta P$ is a binary datum stored in RAM as the value of the second differential of P with respect to time t, $d^2P/dt^2$, and 1 of LSB (the lowermost bit) of $\Delta\Delta P$ corresponds to 1.22 mmHg. Thus, when $\Delta\Delta P$ is 50 mmHg, $\tau au$ is about 2.6 msec. Thus, in the acceleration period and when $\Delta\Delta P(k)>B$ is maintained, the asynchronous acceleration fuel injection is carried out at every 10 msec.

Step 75 is executed following the execution of steps 67 and 71, and FTC is set to an acceleration fuel correction value. In step 75, $FTC+C.\Delta\Delta P$ is substituted in FTC, where C is a constant.

The final injection amount Tf of fuel injected from the fuel injector 13 in synchronization with the crank angle is represented by the following formula:

$$Tf=Tp\times f(k)\times f(G)\times(1+FTC)$$

where Tp is the basic fuel injection amount proportional to P/N (N is rotational speed of an engine), f(K) is a correction factor with respect to cooling water temperature, intake temperature, output of oxygen sensor 28, etc., and f(G) is a correction factor with respect to learning control of air-fuel ratio. Thus, the more FTC increases, the more Tf increases.

Figure 4:
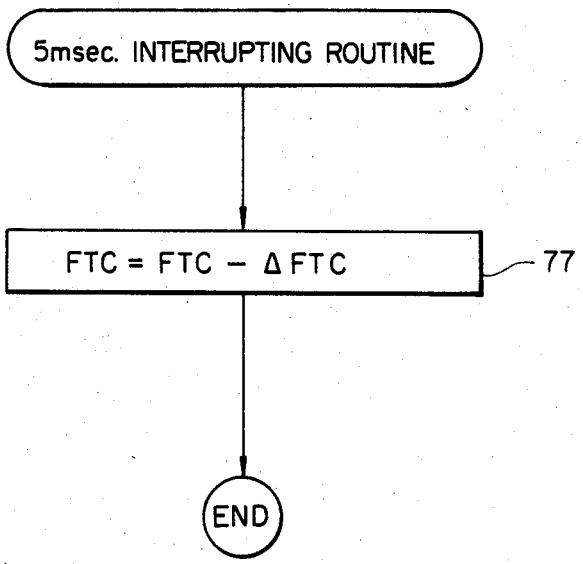
FIG. 4 is a flow chart of a time interrupting program for decreasing acceleration fuel correction value.

FIG. 4 shows an interrupting routine carried out every 5 msec. for reducing FTC. In step 77, the value of FTC less predetermined value $\Delta FTC$, i.e., $FTC-\Delta FTC$ is substituted in FTC.

Figure 5:
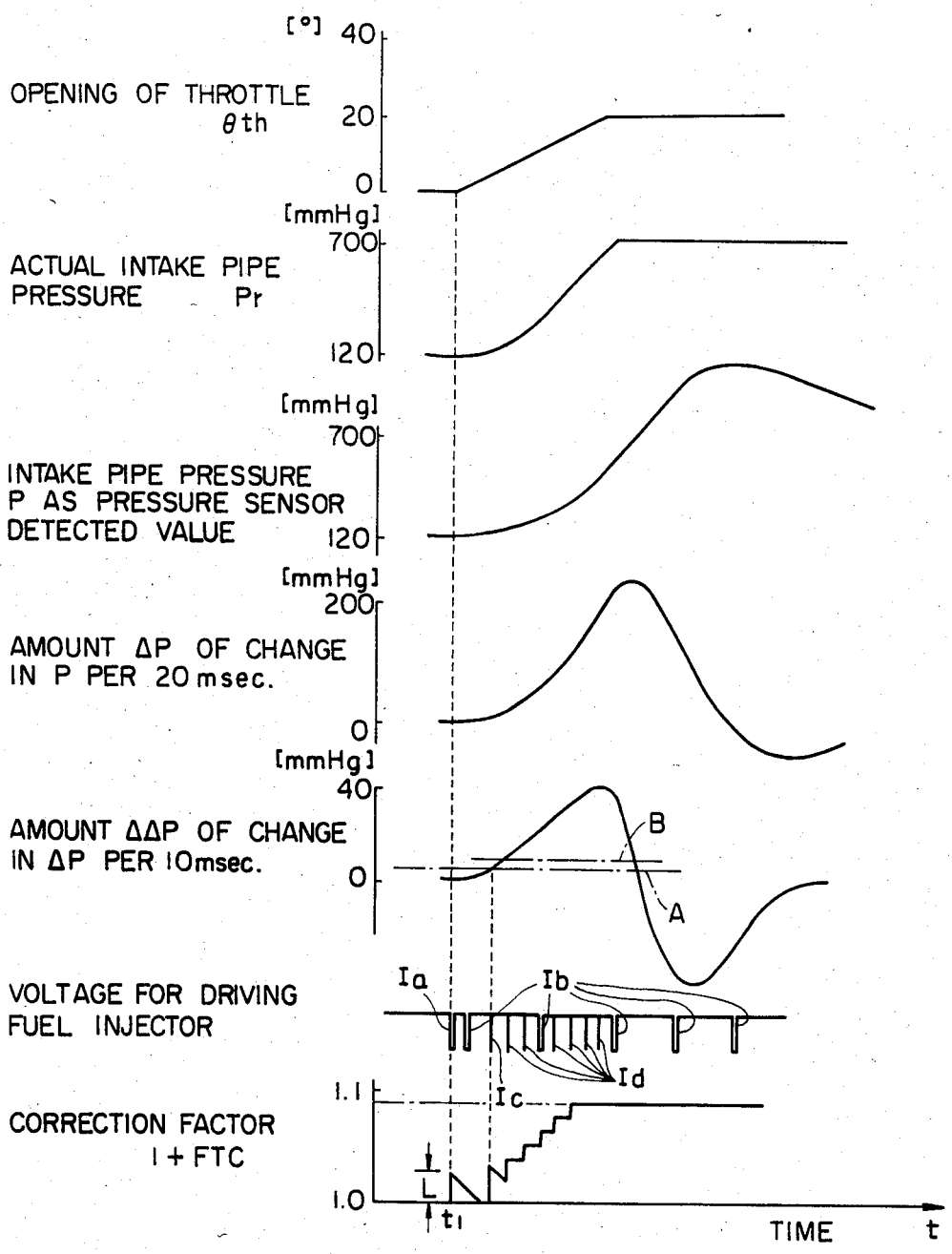
FIG. 5 is a graph showing changes in acceleration fuel correction and other factors with respect to time in the electronically controlled engine for executing the program in FIG. 3.

FIG. 5 shows changes with respect to time in the opening $\theta$th of throttle during the period of acceleration, actual intake pipe pressure Pr, intake pipe pressure P detected by pressure sensor 12, amount $\Delta P$ of change in P per 20 msec., amount $\Delta\Delta P$ of change in $\Delta P$ per 10 msec., voltage for driving fuel injector 13 and 1+FTC. When the driving voltage is at a low level, the fuel injector 13 is maintained at an opened condition to inject fuel. When acceleration is started in time t1, the opening $\theta$th of throttle is increased from 0°. Consequently, the actual intake pipe pressure Pr is increased so that the intake pipe pressure P as value detected by the pressure sensor 12 is also increased. P has an overshoot.

Fuel injection Ia is carried out when the idle switch 11 is changed over from the turned-on to turned-off condition. Synchronous fuel injection Ib is carried out in synchronization with the crank angle and corresponds to injection amount P, thereby an amount corrected by basic fuel cooling water temperature as a function of engine load. Asynchronous acceleration fuel injection Ic is carried out accompanying the execution of step 66 and when $\Delta\Delta P$ exceeds the predetermined value A after time t1.

Asynchronous acceleration fuel injection Id is carried out accompanying the execution of step 71 in 10 msec. cycles when $\Delta\Delta P > B$ is maintained after the execution of Ic. Since the rise of $\Delta\Delta P$ in the start of acceleration is larger than that of $\Delta P$, the start of acceleration is to be promptly and accurately detected to execute the asynchronous acceleration fuel injection, and since the increase of $\Delta\Delta P$ reflects the increase of the opening $\theta$th of throttle, the asynchronous acceleration fuel injection Id is to be carried out in response to the condition of acceleration. 1+FTC is increased by a predetermined amount L as the idle switch 11 at time t1 is changed over from the turned-on to turned-off condition, and thereafter decreased by $\Delta$FTC every time step 77 in FIG. 4 is executed.

When $\Delta\Delta P$ exceeds A, 1+FTC is increased by $C \cdot \Delta\Delta P$, and increased to the predetermined upper limit every time step 73 in FIG. 3 is executed. Thereafter, $1+FTC > 1.0$ is maintained for a while even after $\Delta\Delta P < B$ is provided so that acceleration fuel of synchronous fuel injection continues to be increased. Thus, fuel injection amount is to be accurately set to the condition of acceleration.

Figure 6:
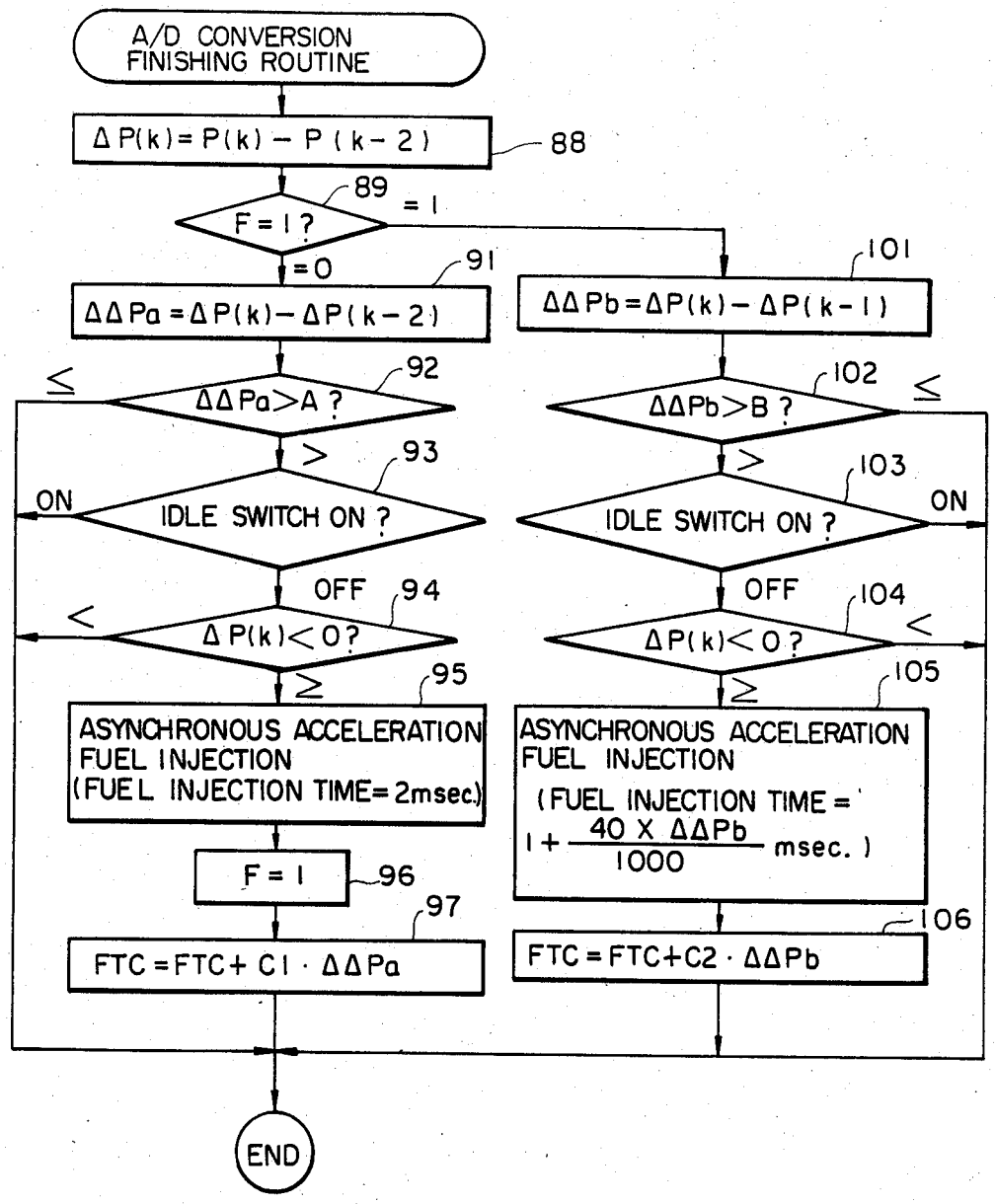
FIG. 6 is a flow chart of another program according to the present invention.

FIG. 6 is a flow chart of another program according to the present invention. This program is executed at every 10 msec. as an interrupting routine accompanying the completion of A/D conversion of P similarly to the program in FIG. 3. In step 88, the difference $P(k)-P(k-2)$ between the intake pipe pressure P(k) in this time and the intake pipe pressure $P(k-2)$ is computed for $\Delta P$ before 20 msec.

In step 89, it is judged whether flag F is 1 or 0 and the program proceeds to step 91 if $F=0$ and to step 101 if $F=1$. The flag F is reset when the idle switch 11 is changed over from the turned-on to turned-off condition, and then set on step 96 which will be described later. Thus, $F=0$ when the first asynchronous acceleration fuel injection is not still carried out, and the program proceeds to step 91.

In step 91, the difference $\Delta P(k)-\Delta P(k-2)$ between $\Delta P(k)$ in this time and $\Delta P(k-2)$ in two times before this time, i.e. before 20 msec. is substituted in $\Delta\Delta Pa$.

In step 92, it is judged whether or not $\Delta\Delta Pa >$ predetermined value A, and the program proceeds to the succeeding step only when $\Delta\Delta Pa > A$. In step 93, it is judged whether the idle switch 11 is turned on or off and the program proceeds to the succeeding step only when said switch is turned off. Thus, the execution of asynchronous acceleration fuel injection in a deceleration period is to be avoided. In step 94, it is judged whether or not $\Delta P(k) < 0$ and the program proceeds to the succeeding step only when $\Delta P(k) \geqq 0$. Thus, the asynchronous acceleration fuel injection during period of decreasing P is to be avoided.

Step 95 is carried out once the asynchronous acceleration fuel injection is not in synchronization with crank angle. Fuel injection time in this asynchronous acceleration fuel injection is selected to be a constant value, for example 2 msec. Also, since A on step 92 is selected smaller than B on step 102, step 95 is to be carried out promptly after acceleration.

In step 96, the flag F is set to 1. Thus, in step 89, $F=1$ for the next time execution of the program. Step 97 will be described later together with step 106.

In step 101, the difference $\Delta P(k)-\Delta P(k-2)$ between $\Delta P(k)$ in this time and $\Delta P(k-1)$ in the previous time, i.e. before 10 msec., is substituted in $\Delta\Delta Pb$. In step 102, it is judged whether $\Delta\Delta Pb > B$, and the succeeding step is carried out only when $\Delta\Delta Pb > B$, provided $B < A$. In step 103, it is judged whether the idle switch 11 is turned in or off, and on step 104, it is judged whether $\Delta P(k) < 0$ or $\geqq 0$, and the program proceeds to the succeeding step only when the idle switch 11 is turned off and $\Delta P(k) \geqq 0$. Step 105 is carried out for the asynchronous acceleration fuel injection in which fuel injection time $\tau au$ is represented by the following formula;

$$\tau au = 1 + (40 \times \Delta\Delta Pb)/1000$$

where $\Delta\Delta Pb$ is a binary datum stored in the RAM and a 1 in LSB (the lowermost bit) of $\Delta\Delta Pb$ corresponds to 1.22 mmHg. Thus, when $\Delta\Delta Pb$ is 50 mmHg, $\tau au$ is about 2.6 msec.

In the acceleration period when $\Delta\Delta Pb > B$ is maintained, step 105 is executed every 10 msec. to carry out the asynchronous acceleration fuel injection. Steps 97 and 106 are carried out respectively following the execution of steps 96 and 105, and FTC if a corrected value for acceleration fuel. In step 97, $FTC + F1 \cdot \Delta\Delta Pa$ is substituted for FTC, and in step 106, $FTC + C2 \cdot \Delta\Delta Pb$ is substituted for FTC, where C1 and C2 are constants. Since the final fuel injection amount Tf is represented by a formula similar to that in FIG. 3, the more FTC is increased, the more TF is increased.

Figure 7:
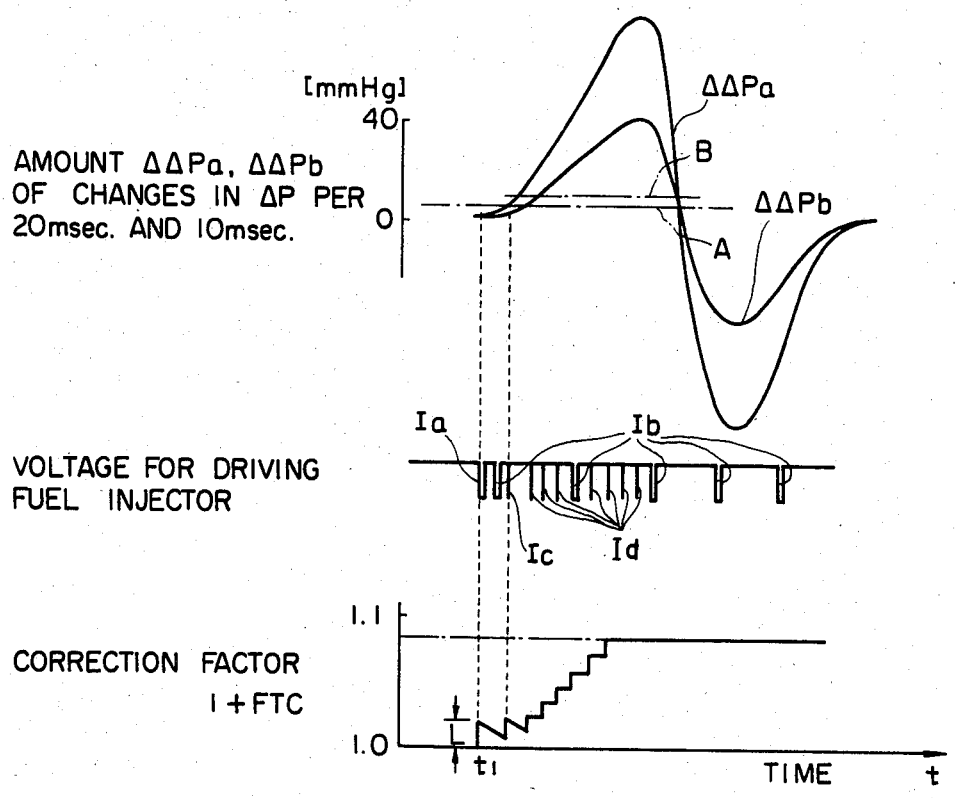
FIG. 7 is a graph showing changes in acceleration fuel correction and other factors with respect to time in the electronically controlled engine for executing the program in FIG. 3.

FIG. 7 shows changes with respect to time in $\Delta\Delta Pa$ and $\Delta\Delta Pb$ during the acceleration period of electronically controlled engine executing the program in FIG. 3, with the voltage for driving the fuel injector 13 and 1+FTC. Ia, Ib, Ic and Id are as described in FIG. 5. To carry out as promptly as possible the first one of a series of asynchronous acceleration fuel injections, A is to be selected to be a small value. However, the value of A is limited so as to prevent wrong operations due to noises. In this embodiment, the amount $\Delta\Delta Pa$ of change in $\Delta P$ for a sufficiently long time, for example, per 20 msec. is detected and compared with A so that the initial asynchronous acceleration fuel injection Ic can be advanced while the period of increasing 1+FTC on which the computation of synchronous acceleration fuel injection to be advanced is based.

While in the present embodiment the electronically controlled engine for computing the basic fuel injection amount according to the intake pipe pressure P is shown, this invention can also apply to the electronically controlled engine for computing the basic fuel injection an amount according to the intake air flow rate Q. In such a case, P, $\Delta P$, $\Delta\Delta P$, and $\Delta\Delta Pb$ in FIG. 3 and FIGS. 5 to 7 are replaced by Q, $\Delta Q$, $\Delta\Delta Q$, $\Delta\Delta Qa$ and $\Delta\Delta Pb$ respectively.

Thus, according to the present invention, the synchronous fuel injection amount is increased in relation to the secondary differential of intake pipe pressure and intake air flow rate with respect to time t, i.e., $d^2X.dt^2$ so that the amount of fuel during acceleration period can be accurately injected in relation to the condition of acceleration.

What is claimed is:

1. An electronically controlled fuel injection system to inject fuel from a fuel injector to an intake system having an intake pipe pressure and an air flow rate comprising:

means for detecting a quantity X equal to one of said intake pipe pressure and an air flow rate with respect to time;

means for determining a basic fuel injection amount as a function of X;

means for detecting a second differential $d^2X/dt^2$ of X with respect to time; and means for increasing synchronous fuel injection in relation to said second differential.

2. An electronically controlled fuel injection system as defined in claim 1, wherein said differential detecting means includes means for detecting said second differential in a predetermined cycle, and wherein said fuel injection increasing means includes means for carrying out a first increase of synchronous acceleration fuel injection if said second differential exceeds a first predetermined value and means for carrying out an increase of synchronous acceleration fuel injection in the second and succeeding cycles if said second differential exceeds a second predetermined value.

3. A system as defined in claim 2 wherein said means for calculating $d^2X/dt^2$ comprises means for calculating an amount $\Delta X$ of change of X per a first predetermined time and for calculating as $d^2X/dt^2$ an amount $\Delta\Delta X$ of change of $\Delta X$ per a second predetermined time.

4. A system as defined in claim 3 wherein the increase of synchronous fuel injection when $\Delta\Delta X$ is greater than said first predetermined value is different than when $\Delta\Delta X$ is greater than said second predetermined value.

5. A system as defined in claim 3, wherein said first predetermined value is greater than said second predetermined value.

6. A system as defined in claim 1 wherein an increase of a synchronous fuel injection according to $d^2X/dt^2$ decreases by a predetermined amount in succeeding cycles.

* * * * *

UNITED STATES PATENT AND TRADEMARK OFFICE

CERTIFICATE OF CORRECTION

PATENT NO. : 4,607,603

DATED : August 26, 1986

INVENTOR(S) : Kobayashi et al.

It is certified that error appears in the above-identified patent and that said Letters Patent is hereby corrected as shown below:

On the line directly beneath: (30) Foreign Application Priority Data, delete "Mar." and insert -- Aug. --.

Signed and Sealed this

Twenty-first Day of April, 1987

*Attest:*

DONALD J. QUIGG

*Attesting Officer*

*Commissioner of Patents and Trademarks*